United States Patent [19]

Popp

[11] 3,987,998

[45] Oct. 26, 1976

[54] SERVO VALVE CONTROL SYSTEM

[75] Inventor: Roger C. Popp, Chesaning, Mich.

[73] Assignee: Chandler Evans Inc., West Hartford, Conn.

[22] Filed: Aug. 3, 1972

[21] Appl. No.: 277,592

[52] U.S. Cl. ..... 251/28; 251/42; 251/44; 251/38

[51] Int. Cl.[2] ..... F16K 31/363

[58] Field of Search ..... 251/42, 44, 14, 29, 251/28, 25, 38; 137/82, 84

[56] References Cited

UNITED STATES PATENTS

| | | | |
|---|---|---|---|
| 1,132,886 | 3/1915 | Stewart | 251/42 X |
| 2,637,332 | 5/1953 | Longworthy | 251/14 X |
| 3,008,480 | 11/1961 | Fleming | 137/82 X |
| 3,103,337 | 9/1963 | Forte | 251/44 X |

*Primary Examiner*—Alan Cohan

[57] ABSTRACT

A hydraulic servo valve assembly and a control system therefor employing a pneumatic sensor-actuator are disclosed. The servo valve assembly comprises a servo-operated power valve assembly including a differential piston, a solenoid operated override and hysteresis adjustment. The valve assembly is a "snap-action" device wherein the power valve differential piston is selectively positioned through use of the pneumatic sensor controlled servo valve to vent the pressure applied to the larger area reaction surface of the piston.

7 Claims, 2 Drawing Figures

SERVO VALVE CONTROL SYSTEM

BACKGROUND OF THE INVENTION

1. Field of the Invention

The present invention relates to fluidic control systems and particularly to systems wherein a monitored pressure or pressure ratio is employed to control a servo valve. More specifically, this invention is directed to servo valves especially suited to use in such control systems and characterized by positive feedback, override capability and hysteresis adjustment. Accordingly, the general objects of the present invention are to provide novel and improved apparatus of such character.

2. Description of the Prior Art

While not limited thereto in its utility, the present invention is particularly well suited for use in a pressure ratio bleed control for a gas turbine engine. As is well known, gas turbine engines may exhibit compressor instability under certain operating conditions. Such instability, also known as compressor surge, occurs when there is a rapid reduction in compressor discharge or burner pressure due to the choking effect of air within the compressor. In order to minimize the effects of compressor surge, it is conventional practice to bleed some of the pressure within the compressor to the ambient atmosphere until such time as the engine passes through the unstable region of its performance characteristic curve.

Prior art pressure ratio bleed controls have provided adaquate performance but have been characterized by a number of disadvantages. Thus, by way of example, the typical prior art control derived a mechanical output from a pneumatic pressure ratio sensor and employed this mechanical output to drive a hydraulic power valve via a gas to liquid converter valve assembly. The necessity of employing a converter valve assembly added to the cost, weight and complexity of the prior art controls while adversely affecting their reliability. Also, prior art pressure ratio bleed controls did not incorporate a simple and convenient override mechanism. A further deficiency of prior art controls was their failure to provide a hysteresis adjustment necessary to compensate for differences in the opening and closing position of the hydraulic valve as commanded by the pneumatic sensor.

SUMMARY OF THE INVENTION

The present invention overcomes the above briefly discussed and other deficiencies and disadvantages of the prior art by providing a novel and improved fluidic control system and a servo valve for use in the system. The control system of the present invention includes a pneumatic sensor unit which provides a mechanical output signal. The mechanical output signal of the pneumatic sensor directly drives a novel hydraulic servo valve assembly. The hydraulic servo valve assembly comprises a servo-operated, differential piston-valve assembly and includes a solenoid operated override mechanism. Also, hysteresis adjustment of the hydraulic valve assembly may be achieved by adjusting the stroke of the differential piston-valve.

BRIEF DESCRIPTION OF THE DRAWING

The present invention may be better understood and its numerous objects and advantages will become apparent to those skilled in the art by reference to the accompanying drawing wherein.

DESCRIPTION OF THE PREFERRED EMBODIMENT

Figure 1:
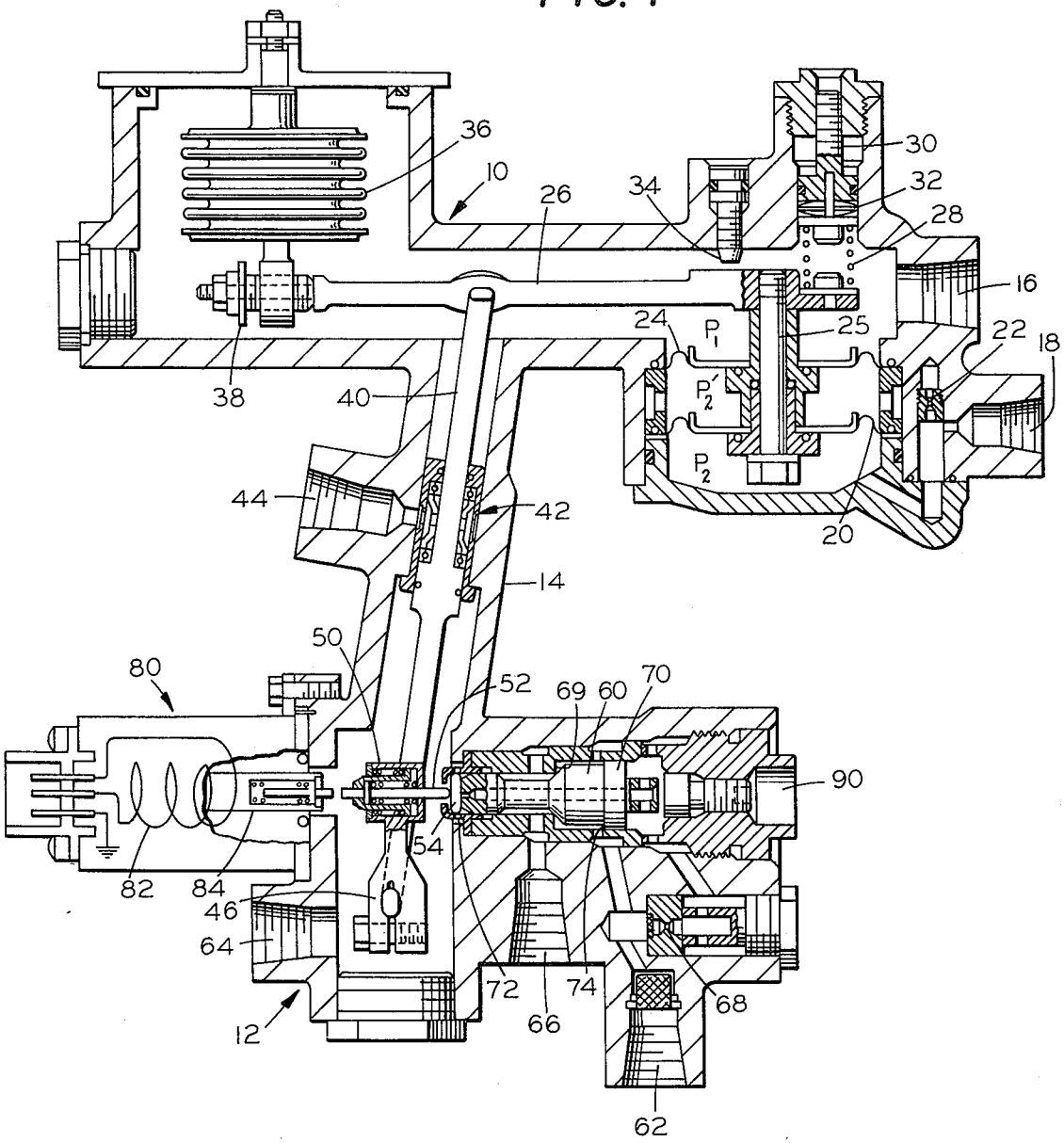
FIG. 1 is a combined orthgonal and schematic view of a preferred embodiment of the invention.

The preferred embodiment of the invention comprises a housing which defines a pneumatic sensor subassembly, indicated generally at 10, and a hydraulic valve subassembly, indicated generally at 12. In the manner to be described below, the pneumatic sensor is mechanically coupled to the hydraulic valve subassembly; this coupling being achieved via connecting portion 14 of the control housing. As will also become apparent from the discussion below, the hydraulic valve subassembly 12 is shown with the valve in the closed position.

In view of the utility of the invention in a pressure ratio bleed control, the pneumatic sensor subassembly 10 has been shown as a force balancing pressure ratio responsive device. A pair of sensed pressures, typically ambient or compressor inlet pressure P1 and a pressure P2 proportional to compressor discharge pressure, are applied to respective inlet ports 16 and 18. The pressure P2, which will be higher than pressure P1, is applied directly to the first side of a flexible diaphragm 20 and, via a restricted flow path 22, to the other side of diaphragm 20 and to the first side of a second diaphragm 24. The use of two diaphragms in this fashion is in the interest of safety, in order to provide a device which will continue to be operable in the case of the rupture of one diaphragm, and is in accordance with conventional practice in the art. The diaphragms 20 and 24 are mechanically connected to a lever 26, adjacent a first end thereof, by means which includes a bolt 25. The first end of the lever is spring biased in the downward direction by an adjustable biasing mechanism which includes spring 28 and a movable stop 30 for the spring. The biasing mechanism also includes a temperature compensation device 32 which may, for example, comprise a bimetallic disc. A first lever travel stop 34 is provided adjacent the point of connection between the lever 26 and bolt 25 while the head of bolt 25 defines a stop for movement away from stop 34.

The opposite end of lever 26 is supported by an evacuated bellows 36 which establishes a P1 pressure reference. A lever ratio slope adjustment device 38 is provided at the point of connection between lever 26 and bellows 36. Intermediate its length lever 26 is pinned to an output shaft 40 which extends through housing portion 14. For convenience of illustration, shaft 40 has been shown extending downwardly at an angle to lever 26. As will be obvious to those skilled in the art, in actual practice shaft 40 provides a fixed fulcrum upon which lever 26 pivots and thus shaft 40 will be oriented perpendicularly to the plane of pivoting movement of lever 26.

Should P1 decrease with respect to P2, the forces produced by the resultant pressure differential across the diaphragms 20 and 24 will result in upward movement thereof against the bias of spring 28 and consequently in the counter-clockwise rotation of output shaft 40. Conversely, a decrease in the P1/P2 ratio will result in clockwise rotation of shaft 40. As will become apparent from the discussion below, the control is a snap-action device whereby a power valve will be opened when a preselected P1/P2 ratio is exceeded and the power valve will be closed when a second, and usually lower, P1/P2 curve is passed as the pressure ratio decreases. The device has been shown in a condition where the P1/P2 ratio has increased to the power valve opening threshold.

Within housing portion 14 shaft 40 passes through a rotating seal, indicated generally at 42, which provides isolation between the gaseous environment within the pneumatic sensor subassembly 10 and the liquid environment within the hydraulic valve subassembly 12. A drain port 44 communicates with seal 42 to provide for bleeding off any hydraulic fluid which leaks past the initial shaft seals and into the interior of the sealing means.

Within the portion of the housing which defines the hydraulic valve subassembly, the second end of output shaft 14 is connected to a lever and clamp mechanism 46 which transmits the rotating motion of shaft 40 to a servo operator indicated generally at 50; servo operator 50 and lever 26 thus pivoting in unison about the axis of shaft 40. With a P2/P1 pressure ratio below the threshold value as depicted, the shaft 40 generates a clockwise torque. This torque is applied to servo operator 50. The output shaft 52 of the servo operator controls the position of a disc 54 which in part defines a servo valve. When clockwise torque is generated by the pneumatic sensor, the servo valve is driven to the closed position wherein the disc 54 is in contact with the end of differential piston-power valve member 60. The servo operator 50 includes a spring loaded overtravel mechanism as shown.

As noted, the hydraulic valve subassembly also includes an output or power valve member 60 in the form of a differential piston. In addition, the valve subassembly comprises inlet port 62, bleed port 64 and a discharge port 66; port 66 being connected to a load. The load will typically be a hydraulically operated compressor bleed valve assembly. The working fluid for the hydraulic valve subassembly of the present invention will, in the environment of a pressure ratio bleed control, typically be the pressurized fuel for the engine; liquid at a relatively high pressure, on the order of 1000 psi, being applied to port 62 and port 64 being maintained at a lower pressure, typically on the order of 150 psi.

Figure 2:
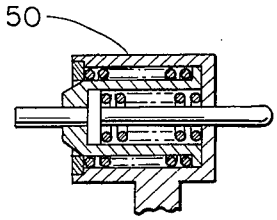
FIG. 2 is an isolated view of the servo operator 50 of FIG. 1.

With the servo valve closed as shown the high pressure fluid at inlet port 62 will be applied, via a servo flow control orifice 68, to the large end of the output valve member 60. Member 60 is provided with a pressure relief passage 70 therethrough which, with the servo valve closed, is sealed by disc 54. Accordingly, with the servo valve closed, member 60 will be unbalanced in the closed position. Valve member 60 will thus be hydraulically urged toward servo valve 54, and, through the action of the servo operator overtravel mechanism, against a cooperating sealing surface 69 internally of the housing. Although not shown in such condition, the servo operator mechanism will be overtraveled at this time as shown in FIG. 1 and communication between supply port 62 and discharge port 66 will be prevented. FIG. 2 depicts servo operator 50 in the position it would take, for example, during movement of shaft 52 away from servo valve disc 54.

Should the P2/P1 pressure ratio increase above the preset threshold, shaft 40 will rotate thereby generating a counterclockwise torque which will withdraw the servo operator shaft 52 from disc 54. As the servo valve flow area at the end of member 60 increases, disc 54 being moved to the left under the influence of pressure to uncover port 72, it approaches the magnitude of the flow area of flow control orifice 68. The opening of the servo valve permits bleeding down of the pressure acting on the large end of valve member 60 to the level of the pressure applied to inlet port 64. When the pressure at the large end of valve member 60 declines sufficiently, the valve will become unbalanced toward the open position through the action of the high pressure fluid on shoulder 74 of member 60. Valve member 60 will thus begin to move. During the first motion of output valve member 60 the servo opening is correspondingly increased and the output valve becomes increasingly unbalanced toward the open position. This results in a snap-action opening of valve 60 thereby establishing communication between inlet port 62 and discharge port 66.

Should the P2/P1 ratio decrease, a counterclockwise torque will be developed as a result of the movement of shaft 40 and the servo operator output shaft 52 will move toward servo valve disc 54. Movement of disc 54 to the right, considering the embodiment shown, will result in decreasing the servo opening and the pressure at the large end of output valve member 60 will begin to build up. When the pressure differential across the output valve piston becomes sufficiently high the valve will become unbalanced in the closed direction causing a snap-action closing of the valve to the position shown. The closing P1/P2 ratio will be lower than the opening ratio, due to inherent hysteresis of the system, and means must be provided to compensate for this hysteresis. The compensation means of the present invention will be discussed below.

The hydraulic control valve subassembly of the present invention also includes an override mechanism indicated generally at 80. Override mechanism 80 comprises a solenoid 82 which operates a plunger mechanism 84; the plunger mechanism also being provided with an overtravel device as shown. The solenoid 82 can be energized at any time, for example during a gas turbine engine thrust reversal mode, whereby the output shaft of the plunger mechanism 84 will contact the servo operator output shaft 52 forcing the servo operator toward the servo valve 54 thereby causing the servo valve to close. The closing of the servo valve will, in the manner described above, result in the closing of the power valve 60.

As will be obvious from the description above, the stroke of the output valve member 60 results in a difference in servo operator position for opening and for closing the output valve. As previously discussed, this position difference is realized as a P2-P1 opening and closing ratio difference at the computing end of a pressure ratio bleed control and appears as hysteresis. This hysteresis is proportional to output valve travel and is adjustable in magnitude by means of a valve travel stop adjustment 90 which limits the movement of member 60 to a very short stroke.

While a preferred embodiment has been shown and described, various modifications and substitutions may be made thereto without departing from the spirit and scope of the invention. Thus, by way of example, the pneumatic subassembly 10 of the invention may take the form of a pressure sensor rather than a differential pressure responsive device. Accordingly, it is to be understood that the present invention has been described by way of illustration and not limitation.

What is claimed is:

1. A fluidic control system comprising:

pressure sensing means;

means coupled to said pressure sensing means for providing a mechanical output signal commensurate with the state of said pressure sensing means;

power valve housing means defining a bore and inlet and discharge passages communicating therewith, said housing means also defining a vent passage communicating with said bore, said housing means inlet passage being adapted to be connected to a source of pressurized working fluid and said housing means discharge passage being adapted to be connected to a fluid consuming load, said housing means vent passage being adapted to be coupled to a region having a pressure less than the pressure of said working fluid;

a differential area power valve piston movable in said housing means bore, said piston cooperating with said bore and said inlet and discharge ports to define the operative state of said valve, said piston having first and second ends at at least a first shoulder, said first end and shoulder respectively defining first and second reaction surfaces, said first reaction surface having a greater area than said second reaction surface, said piston further having a vent passage therethrough between said first and second ends;

means establishing continuous fluid communication between said housing means inlet port and bore, said communication establishing means coupling the source of pressurized working fluid to said first and second reaction surfaces of said piston;

a floating servo valve member positioned in said housing means bore between said piston and housing means vent passage, said servo valve member cooperating with the second end of said piston to control flow through said piston vent passage to thereby control the pressure applied to said piston first end;

a movable output shaft for contacting said floating servo valve member and urging said servo valve member against said piston second end to define the closed position of the servo and power valves, movement of said servo operator shaft away from said floating valve member resulting in the servo valve opening under the influence of the pressure applied to the first end of said piston;

motion transmitting means for applying the mechanical output signal provided by said means coupled to said pressure sensing means to said movable output shaft, said motion transmitting means including sealing means for isolating the environment of said output shaft and servo valve member from the environment of said pressure sensing means; and override means, said override means being selectively operable to operate said output shaft for causing the closing of the servo valve regardless of the instantaneous position of said motion transmitting means.

2. The apparatus of claim 1 wherein said servo operator further comprises:

overtravel means for permitting the closing of said servo valve regardless of the instantaneous position of said power valve piston.

3. The apparatus of claim 1 wherein said pressure sensing means comprises:

pneumatic pressure ratio responsive means having a movable output connector for providing an output signal commensurate with the difference between a pair of sensed gas pressures.

4. The apparatus of claim 3 further comprising:

hysteresis adjustment means, said hysteresis adjustment means cooperating with said power valve means piston to determine the stroke of said piston.

5. The apparatus of claim 1 wherein said override means comprises:

a solenoid operated plunger, said plunger contacting said servo operator output shaft and urging said shaft against said floating valve member and toward the second end of said power valve means piston upon energization of the solenoid.

6. The apparatus of claim 5 further comprising:

hysteresis adjustment means, said hysteresis adjustment means cooperating with said power valve means piston to determine the stroke of said piston.

7. The apparatus of claim 6 wherein said servo operator further comprises:

overtravel means for permitting the closing of the servo valve regardless of the instantaneous position of said piston.

* * * * *